US007287577B2

(12) United States Patent
Choi et al.

(10) Patent No.: US 7,287,577 B2
(45) Date of Patent: Oct. 30, 2007

(54) HEAT EXCHANGER

(75) Inventors: Yong Hwa Choi, Gyeonggi-Do (KR); Sok Ho Lee, Gyeonggi-Do (KR); Hyoung Mo Koo, Gyeonggi-Do (KR)

(73) Assignee: Samsung Electronics Co., Ltd., Suwon (KR)

( * ) Notice: Subject to any disclaimer, the term of this patent is extended or adjusted under 35 U.S.C. 154(b) by 98 days.

(21) Appl. No.: 11/048,857

(22) Filed: Feb. 3, 2005

(65) Prior Publication Data

US 2005/0241813 A1 Nov. 3, 2005

(30) Foreign Application Priority Data

Apr. 28, 2004 (KR) ..... 10-2004-0029720

(51) Int. Cl.
*F28D 1/047* (2006.01)

(52) U.S. Cl. ..... 165/151; 165/181

(58) Field of Classification Search ..... 165/151, 165/181

See application file for complete search history.

(56) References Cited

U.S. PATENT DOCUMENTS

| | | | | |
|---|---|---|---|---|
| 4,691,767 | A * | 9/1987 | Tanaka et al. | 165/151 |
| 4,715,437 | A * | 12/1987 | Tanaka et al. | 165/151 |
| 5,611,395 | A * | 3/1997 | Kang et al. | 165/151 |
| 5,755,281 | A * | 5/1998 | Kang et al. | 165/151 |
| 2005/0284617 | A1 * | 12/2005 | Kobayashi et al. | 165/151 |

FOREIGN PATENT DOCUMENTS

| | | | |
|---|---|---|---|
| JP | 59032792 A | * | 2/1984 |
| JP | 62-9196 A | | 1/1987 |
| JP | 62019694 A | * | 1/1987 |
| JP | 63003181 A | * | 1/1988 |
| JP | 63116093 A | * | 5/1988 |
| JP | 63201496 A | * | 8/1988 |
| JP | 8-291988 A | | 11/1996 |
| JP | 11-173785 A | | 7/1999 |
| JP | 11-281280 A | | 10/1999 |
| JP | 2000-314600 A | | 11/2000 |
| JP | 2003090691 A | * | 3/2003 |
| KR | 0184101 B1 | | 12/1998 |
| KR | 10-0363201 B1 | | 11/2002 |

* cited by examiner

*Primary Examiner*—Leonard R Leo
(74) *Attorney, Agent, or Firm*—Sughrue Mion, PLLC

(57) ABSTRACT

A heat exchanger is provided that is capable of performing heat exchange more efficiently by using slits. The heat exchanger includes a refrigerant pipe for allowing a refrigerant to flow therethrough, at least one fin disposed such that the refrigerant pipe penetrates through the at least one fin for performing heat exchange with air passing by the at least one fin, at least one slit formed by partially cutting out the at least one fin, and at least one slit fin extending from the at least one fin adjacent to one side edge of the at least one slit for inducing turbulent flow in air flowing along a flow channel spaced a predetermined distance from the at least one fin. The width of the at least one slit is greater than or equal to ⅓ of the diameter of the refrigerant pipe. Turbulent flow is induced in air flowing through the heat exchanger by one side edge of the slit disposed downstream of the flow direction of air. Consequently, heat exchange efficiency of the heat exchanger is improved.

5 Claims, 5 Drawing Sheets

HEAT EXCHANGER

CROSS-REFERENCE TO RELATED APPLICATION

This application claims the benefit of Korean Patent Application No. 2004-29720, filed on Apr. 28, 2004 in the Korean Intellectual Property Office, the disclosure of which is incorporated herein by reference.

BACKGROUND OF THE INVENTION

1. Field of the Invention

An apparatus consistent with the present invention relates to a heat exchanger and, more particularly, to a heat exchanger having slit fins for improving heat exchange efficiency.

2. Description of the Related Art

Generally, a heat exchanger is applied to a cooling system for performing heat exchange between a refrigerant and air. An example of the heat exchanger, which is disclosed in Japanese Unexamined Patent Publication No. H 11-173785, comprises a refrigerant pipe along which a refrigerant flows, and a plurality of fins disposed such that the refrigerant pipe penetrates through the fins for increasing a heat exchange area between the refrigerant pipe and air, whereby the refrigerant flowing along the refrigerant pipe is effectively heat-exchanged with the air by means of the fins.

Each fin of the heat exchanger, as mentioned above, is provided with a plurality of slits, by which turbulent flow is created around the fin to improve heat exchange efficiency. The slits are formed by partially cutting out the fin predetermined lengths at predetermined positions. At the fin adjacent to one side edge of the slit is integrally formed a slit fin, which extends from the fin such that the slit fin is partially spaced a predetermined distance from the fin for inducing turbulent flow in air flowing while being at a predetermined distance from the fin.

In the heat exchanger as mentioned above, the slits are incidentally obtained when the slit fins are formed at the fin. However, the width of each slit is less than that of each slit fin with the result that the slit has relatively little influence on air flowing through the heat exchanger, and thus does not improve heat exchange efficiency of the heat exchanger.

SUMMARY OF THE INVENTION

Illustrative, non-limiting embodiments of the present invention overcome the above disadvantages and other disadvantages not described above. Also, the present invention is not required to overcome the disadvantages described above, and an illustrative, non-limiting embodiment of the present invention may not overcome any of the problems described above.

Therefore, it is an aspect of the invention to provide a heat exchanger that is capable of performing heat exchange more efficiently by means of slits.

In accordance with one aspect, the present invention provides a heat exchanger comprising: a refrigerant pipe for allowing a refrigerant to flow therethrough; at least one fin disposed such that the refrigerant pipe penetrates through the at least one fin for performing heat exchange with air passing by the at least one fin; at least one slit formed by partially cutting out the at least one fin; and at least one slit fin extending from the at least one fin adjacent to one side edge of the at least one slit for inducing turbulent flow in air flowing along a flow channel spaced a predetermined distance from the at least one fin, wherein the width of the at least one slit is greater than or equal to ⅓ of the diameter of the refrigerant pipe.

The at least one slit and the at least one slit fin extend such that the at least one slit and the at least one slit fin are substantially perpendicular to the flow direction of air, and the at least one slit fin is partially parallel with the at least one fin while being spaced a predetermined distance from the at least one fin.

The width of the at least one slit fin is substantially equal to that of the at least one slit.

The at least one fin comprises a plurality of fins each having a longitudinal length greater than a lateral length and arranged such that the front of one of the fins is opposite to the rear of another fin while being spaced apart from each other, the refrigerant pipe is bent in a serpentine fashion such that the refrigerant pipe penetrates through the fins several times in the longitudinal direction of the fins, and the at least one slit and the at least one slit fin extends in the longitudinal direction of the at least one fin.

The at least one slit fin comprises: a flat plate part disposed while being substantially parallel with the at least one fin; and leg parts each having one end connected to either end of the flat plate part and the other end connected to either end of the at least one fin adjacent to one side edge of the at least one slit such that the flat plate part is disposed while being spaced a predetermined distance from the at least one fin, and an angle between each of the leg parts and the at least one fin is about 30 degrees.

The at least one slit comprises a plurality of slits, and the at least one slit fin also comprises a plurality of slit fins, the slits and slit fins being successively disposed in the flow direction of air such that turbulent flow is repetitively induced in air flowing along the flow channel. One of the slits, disposed downstream of the flow direction of air, has a width greater than or equal to ⅓ of the diameter of the refrigerant pipe.

In accordance with another aspect, the present invention provides a heat exchanger comprising: a refrigerant pipe for allowing a refrigerant to flow therethrough; a plurality of fins each having a longitudinal length greater than a lateral length and disposed such that the refrigerant pipe penetrates through the fins for performing heat exchange with air flowing between the fins; slits formed by partially cutting out the fins, the slits extending in the longitudinal direction of the fins, respectively; and slit fins extending from the fins adjacent to side edges of the slits such that the slit fins are partially parallel with the fins while being spaced a predetermined distance from the fins, respectively, for inducing turbulent flow in air flowing between the fins, wherein the width of each of the slits and the width of each of the slit fins are greater than or equal to ⅓ of the diameter of the refrigerant pipe.

Each of the slit fins comprises: a flat plate part disposed while being substantially parallel with the corresponding fin; and leg parts each having one end connected to either end of the flat plate part and the other end connected to either end of the corresponding fin adjacent to one side edge of the corresponding slit such that the flat plate part is disposed while being spaced a predetermined distance from the corresponding fin, and an angle between each of the leg parts and the corresponding fin is about 30 degrees.

Additional aspects and/or advantages of the invention will be set forth in part in the description which follows and, in part, will be apparent from the description, or may be learned by practice of the invention.

BRIEF DESCRIPTION OF THE DRAWINGS

These and/or other aspects and advantages of the invention will become apparent and more readily appreciated from the following description of the exemplary embodiments, taken in conjunction with the accompanying drawings, in which.

DETAILED DESCRIPTION OF THE ILLUSTRATIVE, NON-LIMITING EMBODIMENTS OF THE INVENTION

Reference will now be made in detail to an illustrative, non-limiting embodiment of the present invention, an example of which is illustrated in the accompanying drawings. The embodiment is described below to explain the present invention by referring to the figures.

Figure 1:
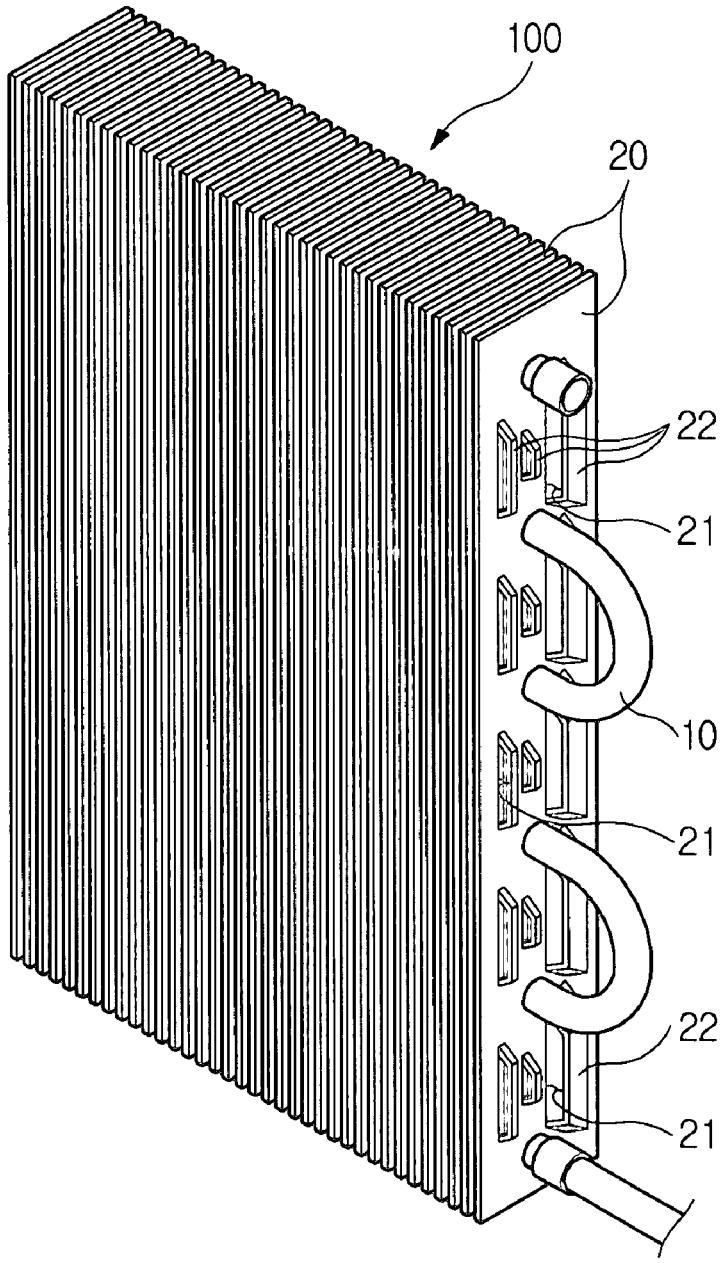
FIG. 1 is a perspective view showing a heat exchanger according to an exemplary embodiment of the present invention.

Referring to FIG. 1, a heat exchanger 100 consistent with the present invention comprises: a refrigerant pipe 10 for allowing a refrigerant to flow therethrough; and a plurality of fins 20 made of metal sheets with high thermal conductivity and disposed such that the refrigerant pipe 10 penetrates through the fins 20 for increasing a heat exchange area between the refrigerant pipe and air.

In this embodiment, each of the fins 20 is formed such that its longitudinal length is greater than its lateral length. The fins 20 are arranged such that the front of one of the fins 20 is opposite to the rear of another fin 20 while being spaced apart from each other. Air flows through the heat exchanger 100 in the lateral direction of the fins 20. The refrigerant pipe 10 is bent in a serpentine fashion such that the refrigerant pipe 10 penetrates through the fins 20 several times in the longitudinal direction of the fins 20.

Figure 2:
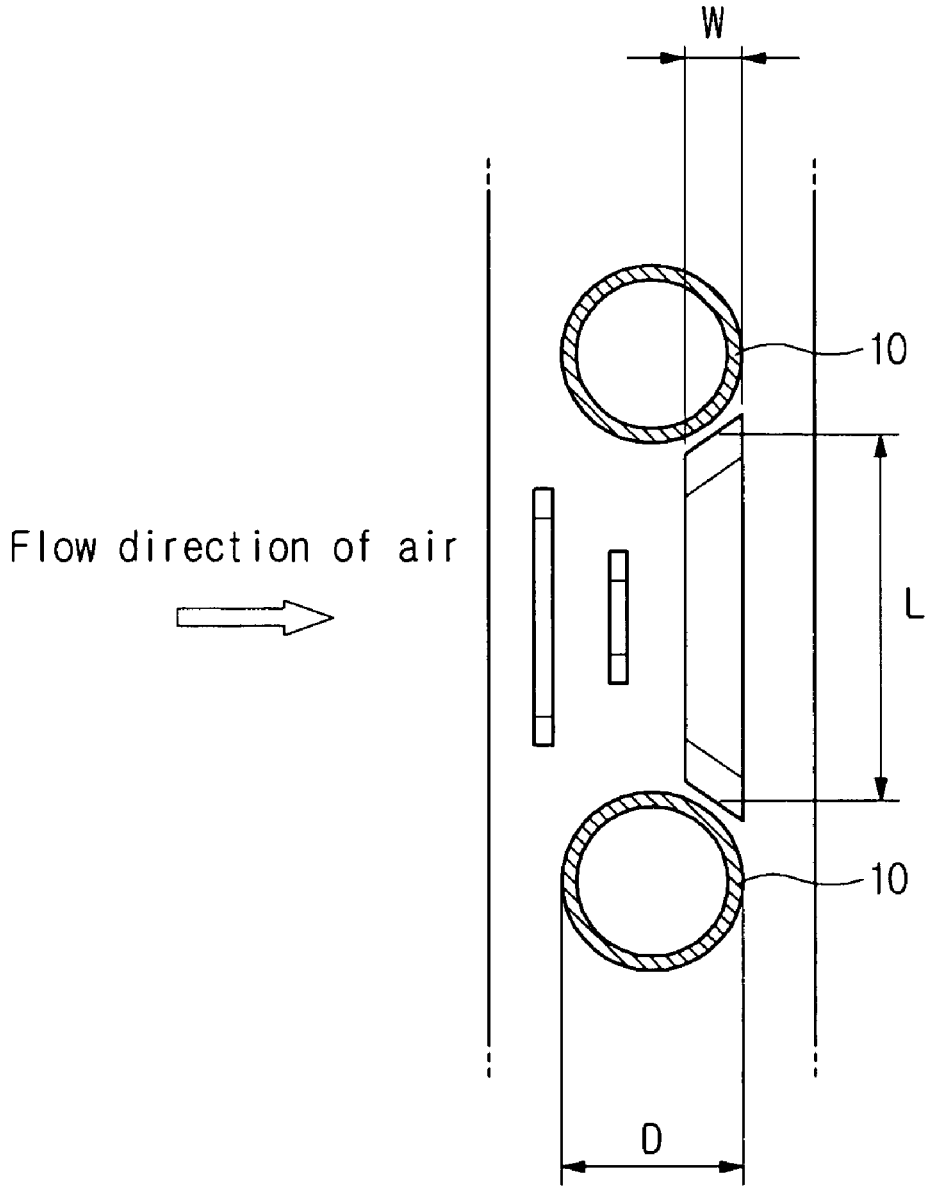
FIG. 2 is a schematic front view showing a fin of the heat exchanger of FIG. 1.
Figure 3:
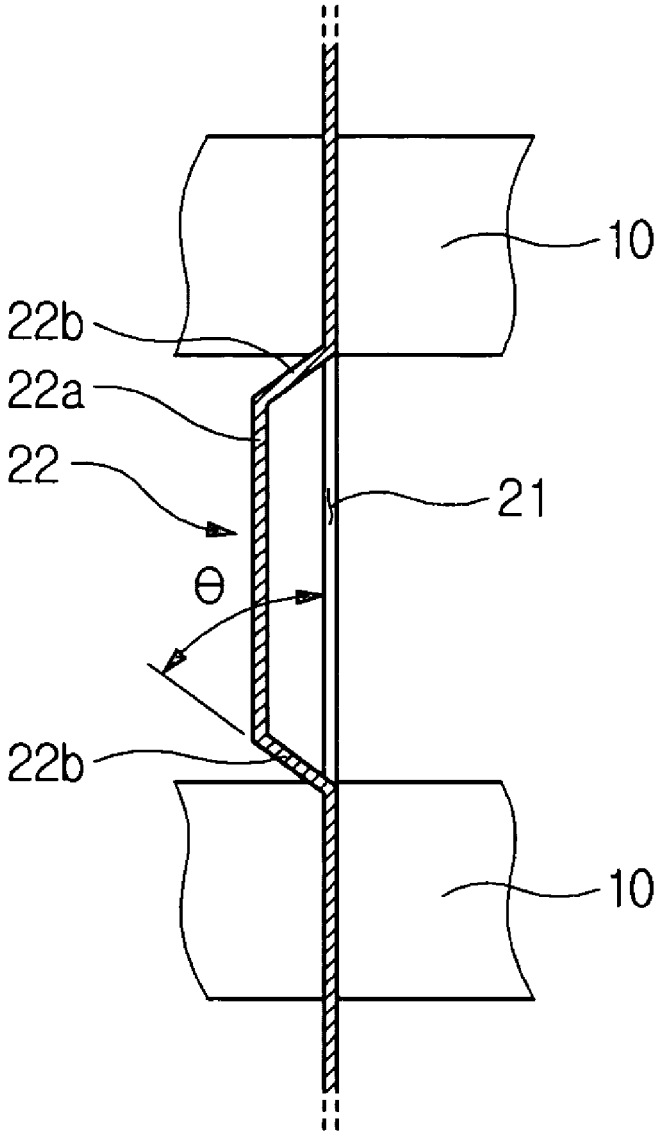
FIG. 3 is a schematic side view showing the fin of FIG. 2.

As is shown in FIGS. 2 and 3, each of the fins 20 is provided with a plurality of slits 21 to induce turbulent flow in air flowing through the heat exchanger 100. The slits 21 are formed by partially cutting out each of the fins 20 at predetermined positions such that each of the slits 21 has a predetermined with W. At the fin 20 adjacent to one side edge of each of the slits 21 is integrally formed a slit fin 22, which extends from the fin 20 such that the slit fin 22 is partially parallel with the fin 20 while being spaced a predetermined distance from the fin 20. In this embodiment, the slits 21 are obtained when the fin 20 is partially cut out to form the slit fins 22. Consequently, the width W of each of the slits 21 is equal to that of each of the slit fins 22.

As is described above, the slit fins 22 are integrally formed at each of the fins 20 adjacent to one side edge of each of the slits 21, and each of the slit fins 22 is partially parallel with each of the fins 20 while being spaced a predetermined distance from each of the fins 20. Consequently, the slit fins 22 induce turbulent flow in air flowing between adjacent fins 20, which are spaced a predetermined distance from each other, thereby improving heat exchange.

Each of the slit fins 22 comprises: a flat plate part 22*a* disposed while being spaced a predetermined distance from the corresponding fin 20; and leg parts 22*b* each having one end connected to either end of the flat plate part 22*a* and the other end connected to either end of the fin 20 adjacent to one side edge of the slit 21.

The slits 21 and the slit fins 22 are disposed between adjacent pipe sections of the serpentine refrigerant pipe 10 while extending in the longitudinal direction of the fin 20 such that the slits 21 and the slit fins 22 are perpendicular to the flow direction of air. Preferably, but not necessarily, the slits 21 and the slit fins 22, each 3 in number, are successively disposed in the flow direction of air such that turbulent flow is repetitively induced in air flowing between the fins 20.

In this exemplary embodiment, one of the slits 21, which is disposed downstream of the flow direction of air, has a predetermined width W sufficient to optimally create turbulent airflow. Air flowing through the heat exchanger 100 is forced against one side edge of the slit 21 disposed downstream of the flow direction of air with the result that turbulent flow is induced in the air by means of the slit 21. When the width W of the slit 21 is increased, the turbulent flow of the air is increased, whereby the heat exchange efficiency of the heat exchanger 100 is improved.

Figure 4:
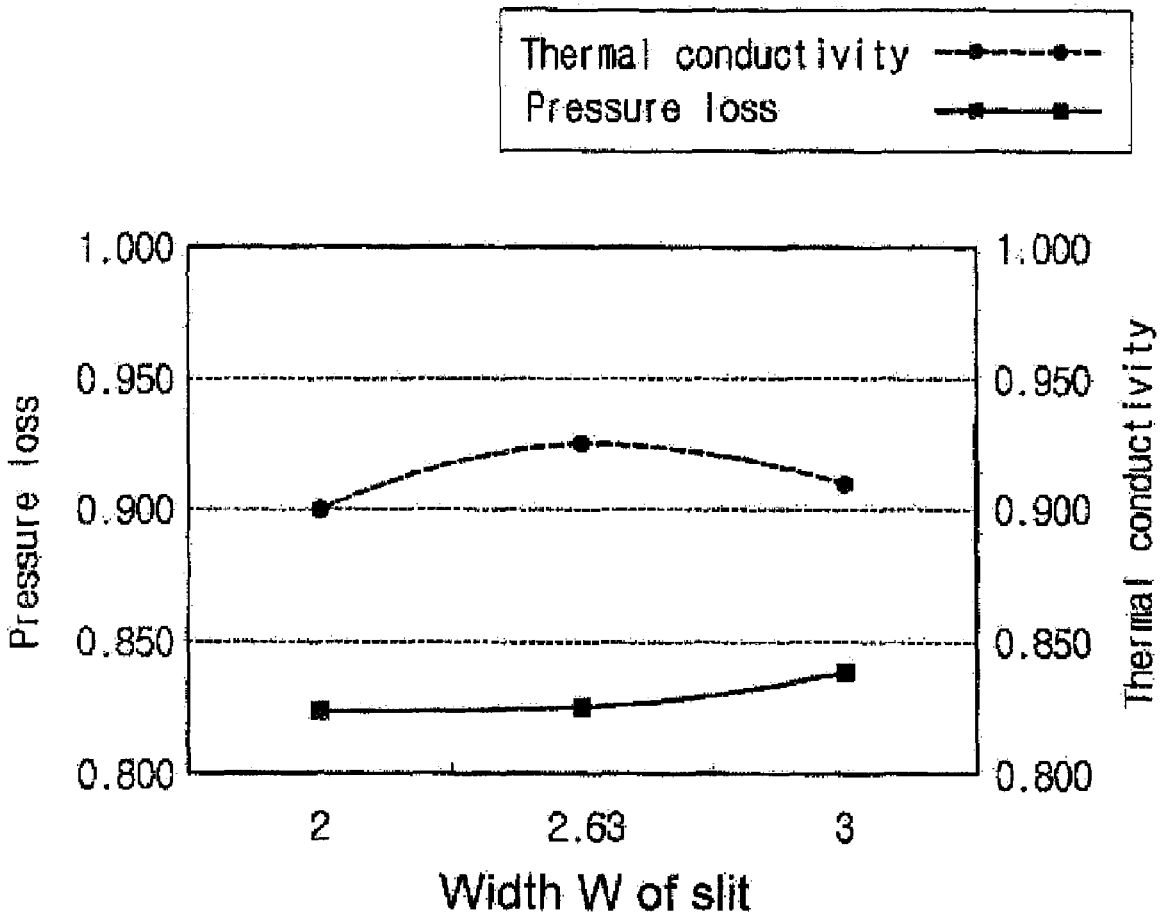
FIG. 4 is a graph illustrating thermal conductivity and pressure loss based on the width of a slit of the heat exchanger of FIG. 1.

The heat exchange efficiency of the heat exchanger 100 was measured under the condition that the width W of the slit 21 was varied while the diameter D of the refrigerant pipe 10 was fixed at 7.3 mm and the length L of the slit 21 was fixed at 6.51 mm, the results of which are shown in FIG. 4. It can be seen from FIG. 4 that the thermal conductivity was maximized when the width W of the slit 21 was 2.63 mm. The pressure loss was abruptly increased when the width W of the slit 21 was greater than 2.63 mm. Consequently, the heat exchange efficiency is optimized when the width W of the slit 21 is 2.63 mm, i.e., the width W of the slit 21 is greater than or equal to ⅓ of the diameter D of the refrigerant pipe 10.

In this embodiment, only the experimental results shown in FIG. 4 is presented as an example, although the relation between the diameter D of the refrigerant 10 and the width W of the slit 21 may be derived through repetitive adjustment of the diameter D of the refrigerant pipe 10 and the length L of the slit 21. The heat exchange efficiency of the heat exchanger 100 is optimized when the following equation is satisfied.

Width $W$ of Slit$\geqq$Diameter $D$ of Refrigerant Pipe$\cdot\frac{1}{3}$

When the width W of the slit 21 is greater than or equal to ⅓ of the diameter D of the refrigerant pipe 10, turbulent flow is induced in air by one side edge of the slit 21 disposed downstream of the flow direction of air, as in the slit fin 22. As a result, the heat exchange efficiency of the heat exchanger 100 is improved.

When the heat exchanger 100 is used as an evaporator that performs heat exchange with air flowing therethrough for cooling the air, moisture contained in the air is condensed in the course of cooling the air flowing through the heat exchanger 100 with the result that the fins 20 and the slit fins 22 are covered with the condensed moisture. When the fins 20 and the slit fins 22 are covered with the condensed moisture, however, the heat exchange efficiency of the heat exchanger 100 is abruptly decreased.

To this end, the leg parts 22*b* of the slit fin 22 are inclined at a predetermined angle to the fin 20 such that the condensed moisture can easily run down by means of gravity. When the leg parts 22*b* of the slit fin 22 are inclined at the predetermined angle to the fin 20, however, the leg parts 22*b* of the slit fin 22 may disturb the flow of air flowing through the heat exchanger 100, by which pressure loss may be incurred.

Figure 5:
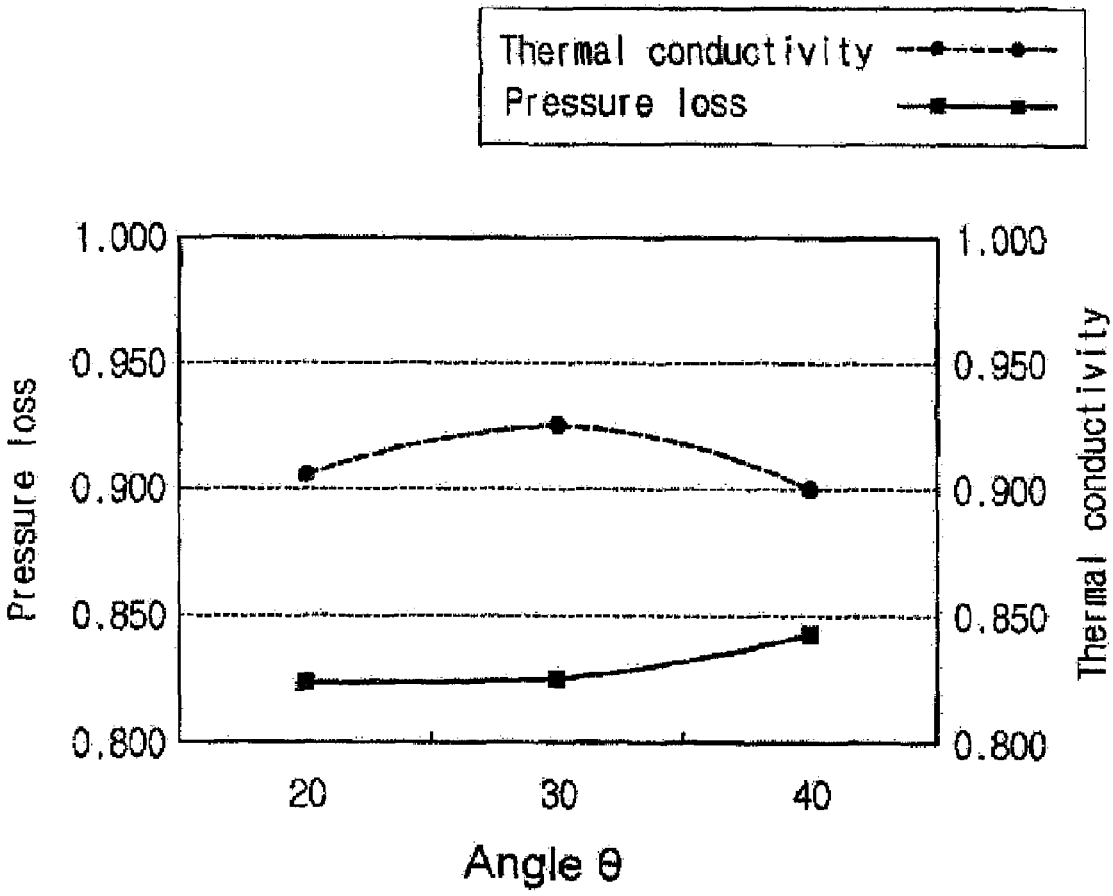
FIG. 5 is a graph illustrating thermal conductivity and pressure loss based on the angle between a leg part of the slit and the fin of the heat exchanger of FIG. 1.

Consequently, it is necessary to provide an optimal angle θ between each leg part 22*b* of the slit fin 22 and the fin 20. The heat exchange efficiency of the heat exchanger 100 was measured under the condition that the angle θ between the leg part 22*b* of the slit fin 22 and the fin 20 was varied while the diameter D of the refrigerant pipe 10 was fixed at 7.3 mm and the length L of the slit 21 was fixed at 6.51 mm, the results of which are shown in FIG. 5. It can be seen from FIG. 5 that the thermal conductivity was maximized when the angle θ between the leg part 22*b* of the slit fin 22 and the fin 20 was 30 degrees. The pressure loss was abruptly increased when the angle θ between the leg part 22*b* of the slit fin 22 and the fin 20 was greater than 30 degrees. Consequently, the heat exchange efficiency is optimized when the angle θ between the leg part 22*b* of the slit fin 22 and the fin 20 is about 30 degrees.

As apparent from the above description, the present invention provides a heat exchanger having slits, each of which has a width greater than or equal to ⅓ of the diameter of a refrigerant pipe such that turbulent flow is more efficiently induced in air flowing through the heat exchanger by one side edge of the slit disposed downstream of the flow direction of air. Consequently, heat exchange efficiency of the heat exchanger is improved.

Furthermore, the angle between each leg part of a slit fin and a fin is 30 degrees, whereby the heat exchanger has low pressure loss while condensed moisture is easily discharged.

Although an exemplary embodiment of the present invention has been shown and described, it would be appreciated by those skilled in the art that changes may be made in this embodiment without departing from the principles and spirit of the invention, the scope of which is defined in the claims and their equivalents.

What is claimed is:

1. A heat exchanger comprising:

a refrigerant pipe for allowing a refrigerant to flow therethrough;

at least one fin disposed such that the refrigerant pipe penetrates through the at least one fin for performing heat exchange with air passing by the at least one fin;

at least one slit formed by partially cutting out the at least one fin; and at least one slit fin extending from the at least one fin adjacent to one side edge of the at least one slit for inducing turbulent flow in air flowing along a flow channel spaced a predetermined distance from the at least one fin, wherein the width of the at least one slit is greater than or equal to ⅓ of the diameter of the refrigerant pipe, wherein the at least one slit and the at least one slit fin extend such that the at least one slit and the at least one slit fin are substantially perpendicular to the flow direction of air, and the at least one slit fin is partially parallel with the at least one fin while being spaced a predetermined distance from the at least one fin; and wherein the at least one slit fin comprises a plurality of slit fins, and wherein each of said plurality of slit fins comprises:

a flat plate part disposed substantially parallel with the at least one fin; and leg parts, each of said leg parts having one end connected to either end of the flat plate part and the other end connected to either end of the at least one fin adjacent to one side edge of the at least one slit such that the flat plate part is spaced a predetermined distance from the at least one fin, and an angle between each of the leg parts of each of said plurality of slit fins and the at least one fin is about 30 degrees.

2. The heat exchanger according to claim 1, wherein the width of the at least one slit fin is substantially equal to that of the at least one slit.

3. The heat exchanger according to claim 1, wherein the at least one fin comprises a plurality of fins each having a longitudinal length greater than a lateral length and arranged in spaced intervals, the refrigerant pipe is bent in a serpentine fashion such that the refrigerant pipe penetrates through the fins several times in the longitudinal direction of the fins, and the at least one slit and the at least one slit fin extend in the longitudinal direction of the at least one fin.

4. The heat exchanger according to claim 1, wherein the at least one slit comprises a plurality of slits, the slits and slit fins being successively disposed in the flow direction of air such that turbulent flow is repetitively induced in air flowing along the flow channel, and wherein one of the slits, disposed downstream of the flow direction of air, has a width greater than or equal to ⅓ of the diameter of the refrigerant pipe.

5. The heat exchanger according to claim 1, wherein the width of the at least one slit is equal to ⅓ of the diameter of the refrigerant pipe.

* * * * *